US006565460B2

(12) United States Patent
Wang

(10) Patent No.: US 6,565,460 B2
(45) Date of Patent: May 20, 2003

(54) FOLDABLE BASKETBALL FRAME ASSEMBLY

(76) Inventor: Cheng-Liang Wang, No. 57, Chung-Ho St., Tainan City (TW)

( * ) Notice: Subject to any disclaimer, the term of this patent is extended or adjusted under 35 U.S.C. 154(b) by 0 days.

(21) Appl. No.: 10/058,344

(22) Filed: Jan. 30, 2002

(65) Prior Publication Data

US 2002/0068650 A1 Jun. 6, 2002

Related U.S. Application Data

(63) Continuation-in-part of application No. 09/576,328, filed on May 22, 2000.

(51) Int. Cl.[7] ..... A63B 69/00
(52) U.S. Cl. ..... 473/431; 473/479
(58) Field of Search ..... 473/480, 481, 473/482, 483, 484–489, 431, 433, 415, 479; 220/9.1–9.3

(56) References Cited

U.S. PATENT DOCUMENTS 2,016,520 A * 10/1935 Short ..... 206/289
4,611,945 A * 9/1986 Diego ..... 403/61
5,312,099 A * 5/1994 Oliver, Sr. ..... 473/433
5,692,976 A * 12/1997 Yu ..... 473/433
6,224,504 B1 * 5/2001 Tien ..... 473/433
6,371,873 B1 * 4/2002 Wang ..... 473/478

* cited by examiner

*Primary Examiner*—Paul T. Sewell
*Assistant Examiner*—M. Chambers
(74) *Attorney, Agent, or Firm*—Rosenberg, Klein & Lee

(57) ABSTRACT

A foldable basketball frame assembly includes a backboard having four flanges extending from four sides of the backboard and a cover is connected to the bottom flange of the backboard. A ring is connected to the top flange. A first transverse bar is connected to the flange on the lower end of the backboard and two two-way connection members are respectively connected to two ends of the first transverse bar. Two foldable siderails are respectively connected the two two-way connection members and a three-way connection member is connected to a distal end of each siderail. A second transverse bar is connected between the two three-way connection members. Two legs are respectively connected to the three-way connection members. All the parts of the assembly can be folded and received in a bag formed by connecting the cover to the flanges on four sides of the backboard.

7 Claims, 9 Drawing Sheets

FOLDABLE BASKETBALL FRAME ASSEMBLY

FIELD OF THE INVENTION

The application is a Continuation-In-Part application for the applicant's former application having the Ser. No. of 09/576,328, filing May 22, 2000 with the same title.

BACKGROUND OF THE INVENTION

A conventional foldable basketball frame assembly is shown in FIG. 9 and generally includes a base portion 5, two side frames 6 and a backboard 8 connected between the two side frame 6. A rim with a net is connected to the backboard 8. The base portion 5 includes two sides and each side has three vertical posts and each vertical post has two three-way fitting members 52 on two ends thereof so that a transverse rod 51 can be connected between any two adjacent fitting members 52. The two sides are then connected by connection bars 510. Each side frame 6 is a five-side member which is composed of long rods 61, first short rods 62 and second short rods 64 both of which are connected by connection members 61. A net member 7 is connected to each side frame 6. An end opposite to the backboard 8 between the two side frames 6 is connected by another rod 63. In the conventional basketball frame assembly, there are involved many parts such as the multi-way fitting members and rods having different lengths. Some of the rods and the fitting members have to be connected correctly to form the frame. This is difficult for kids to assemble it and the more number of parts the frame needs, the higher possibilities the parts could be lost.

U.S. Pat. No. 6,224,504 discloses a basketball practice assembly which is designed to be fixed on a wall by screws and has telescope arms to extend the nets from the case. The arms are composed of multiple plates pivotally connected with each other. The plates are easily to fold and when an impact is happened to the assembly because no suitable secure means is used to hold the status of the plates. This will obviously reduce the interest of the players who have to adjust the telescope arms again an again.

The present invention intends to provide a foldable basketball frame assembly which includes less number of parts and is easily to be assembled. All the parts of the basketball frame assembly can be received in a bag connected to a backboard of the assembly.

SUMMARY OF THE INVENTION

In accordance with one aspect of the present invention, there is provided a foldable basketball frame assembly and comprising a backboard having four flanges extending from four sides of the backboard. A ring is connected to the top flange on a top of the backboard and a cover is connected to the bottom flange on a lower end of the backboard. A first transverse bar is connected to the flange on the lower end of the backboard and two two-way connection members are respectively connected to two ends of the first transverse bar. Two foldable siderails are respectively connected the two two-way connection members and a three-way connection member is connected to a distal end of each siderail. A second transverse bar is connected between the two three-way connection members. Two legs are respectively connected to the three-way connection members.

The object of the present invention is to provide a basketball frame assembly which can be folded and received in a bag attached to the backboard of the assembly.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 6:
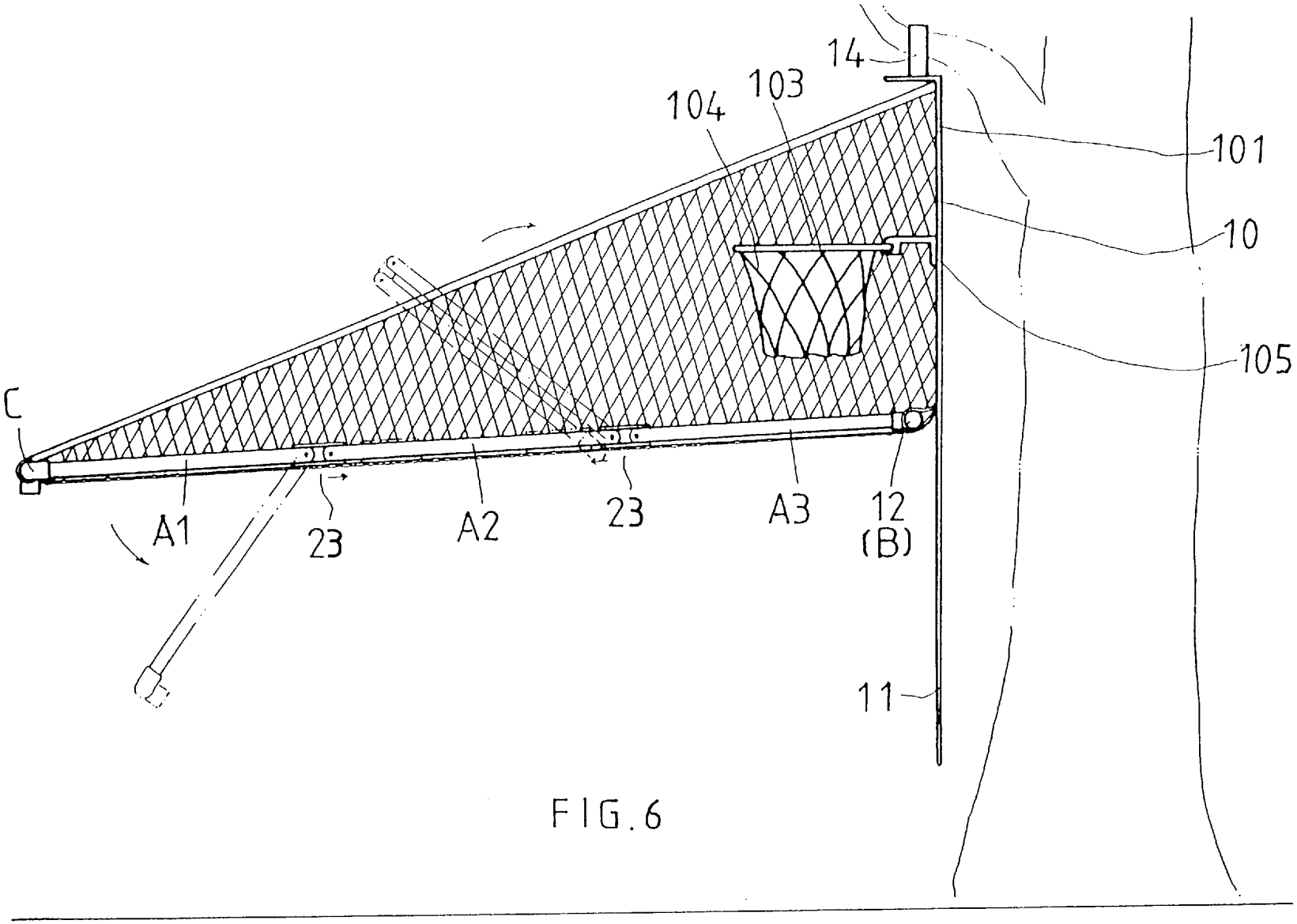
FIG. 6 is a side view to show the two siderails are to be pivoted.
Figure 8:
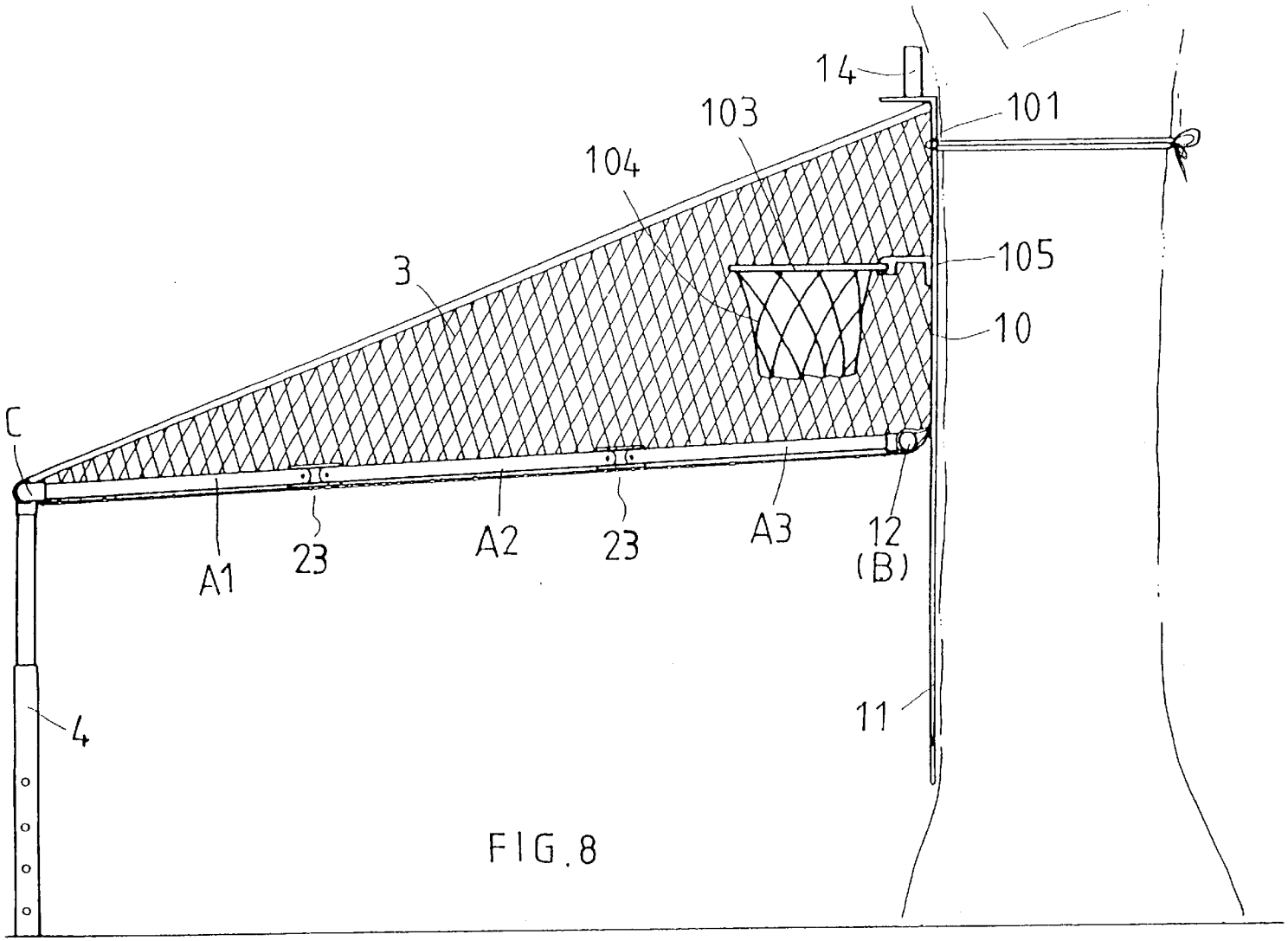
FIG. 8 is a side view to show the frame assembly is connected to a tree.
Figure 9:
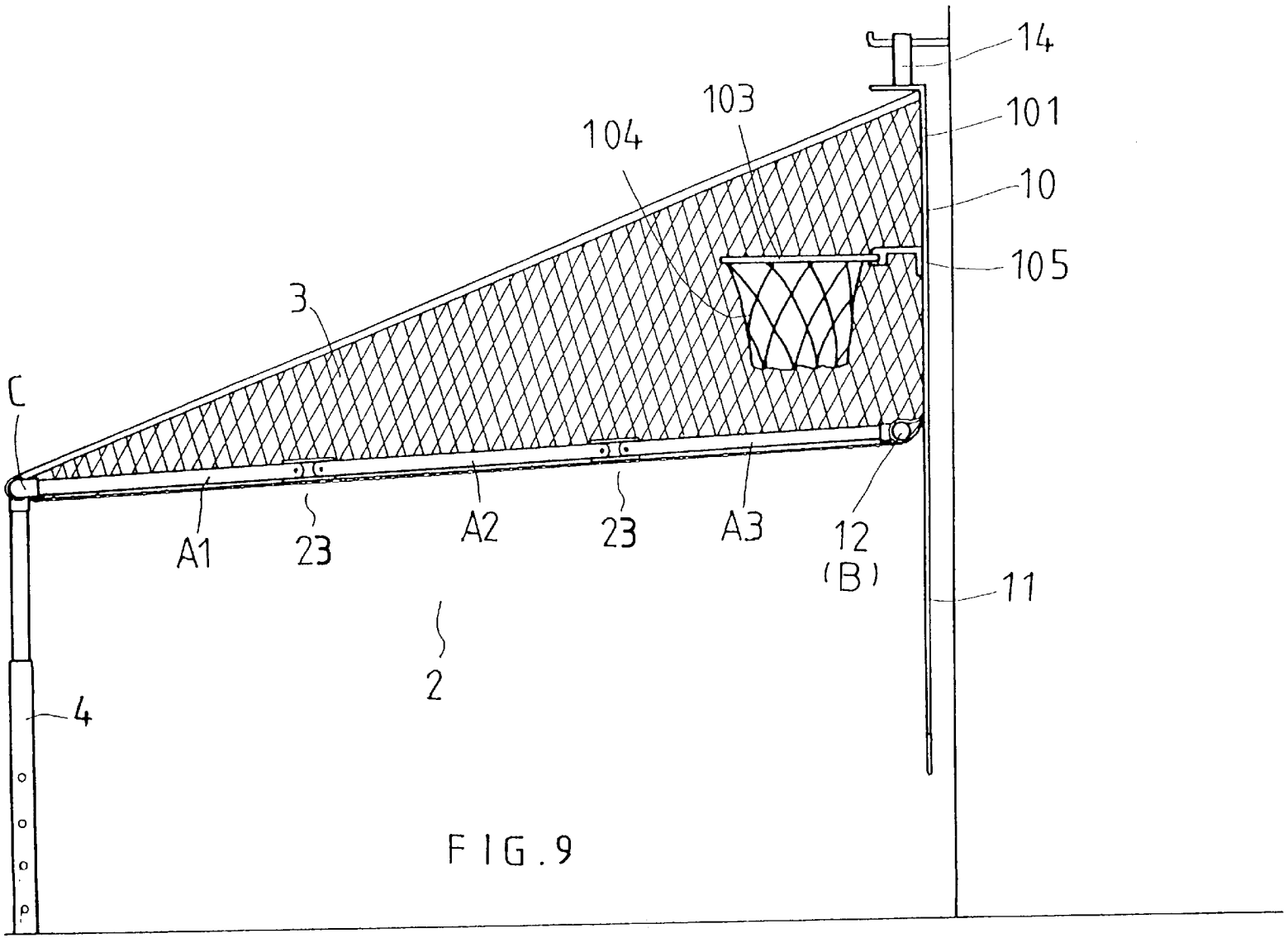
FIG. 9 is a side view to show the backboard is hang on a wall at the ring on the backboard.
Figure 10:
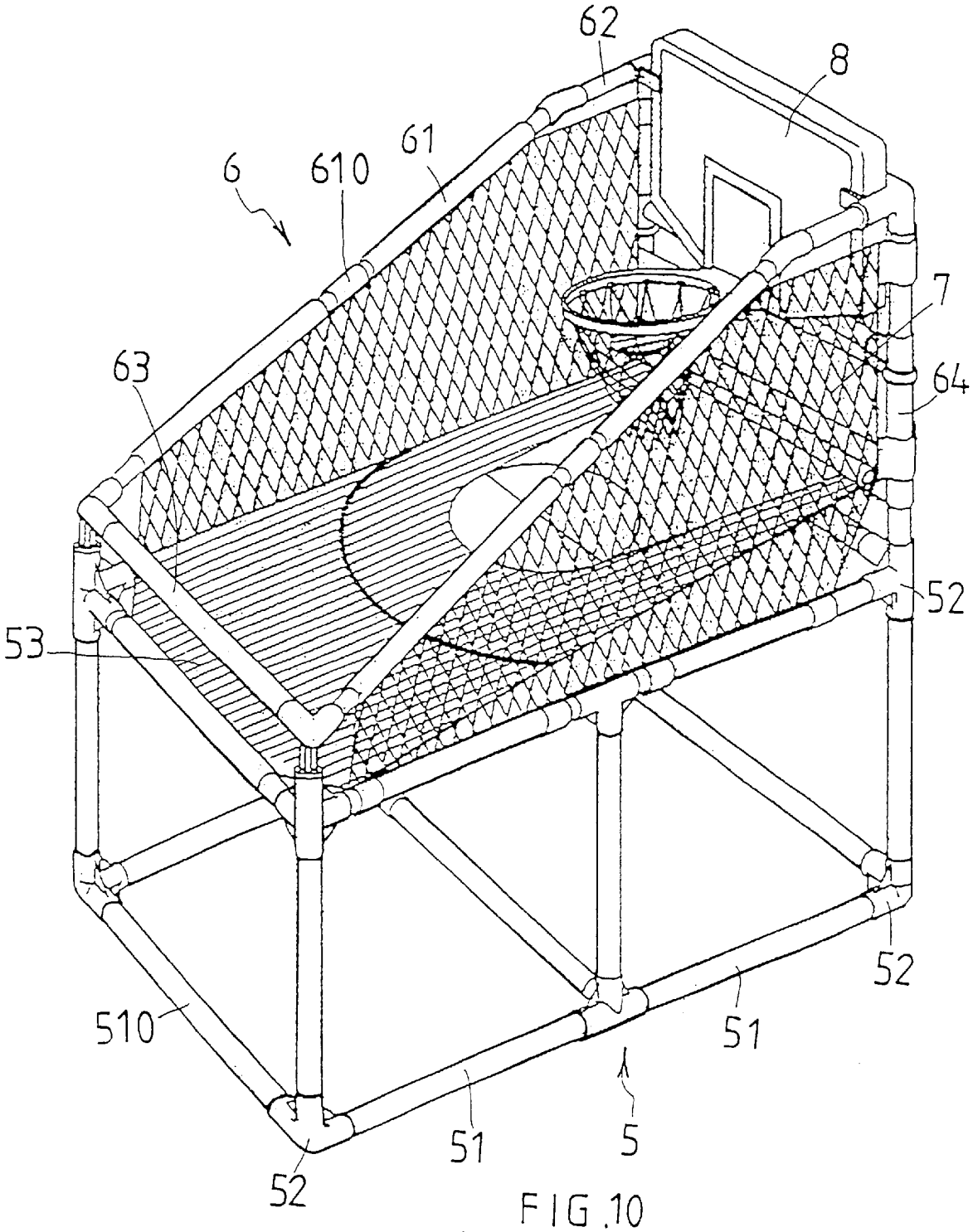
FIG.10 PRIOR ART
FIG. 10 is a perspective view to show a conventional basketball frame assembly.

Referring to FIGS. 1 to 4, the basketball frame assembly in accordance with the present invention comprises a backboard 10 having four flanges 102 extending from four sides of the backboard 10. The four flanges 102 are a top flange, two side flanges and a bottom flange. A cover 11 is connected to the bottom flange on a lower end of the backboard 10 and a zipper means 13 is connected to the cover 11 and the flanges 102 so that the cover 11 is connected to the flanges 102 by the zipper means 13 to form a bag. A ring 14 is connected to the top flange 102 on a top of the backboard 10 and two holes 101 are defined through the backboard 10 and located on two ends of the backboard 10. The ring 14 is used to hang the assembly on a tree as shown in FIG. 6 or on a wall as shown in FIG. 9. The apertures 101 are used to tie the backboard 10 on a tree as shown in FIG. 8. A frame 105 is connected to the backboard 10 and a rim hoop 103 with a net 104 are connected to the frame 105. A rectangle 100 is marked on the backboard 10 above the frame 105. The rectangle is painted by fluorescent paint so as to be seen in a gloomy area.

Figure 1:
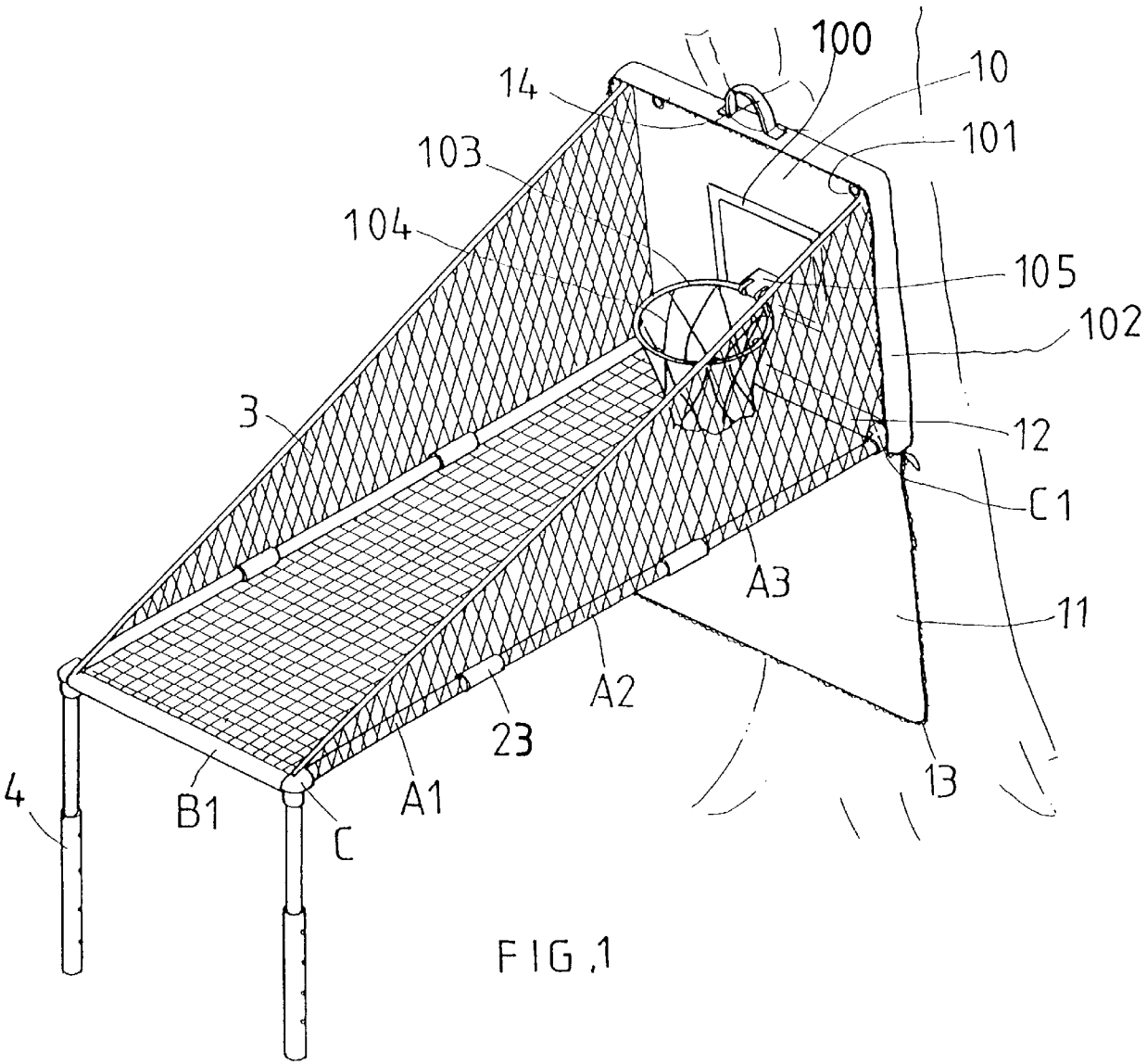
FIG. 1 is a perspective view to show a basketball frame assembly of the present invention.
Figures 2, 3:
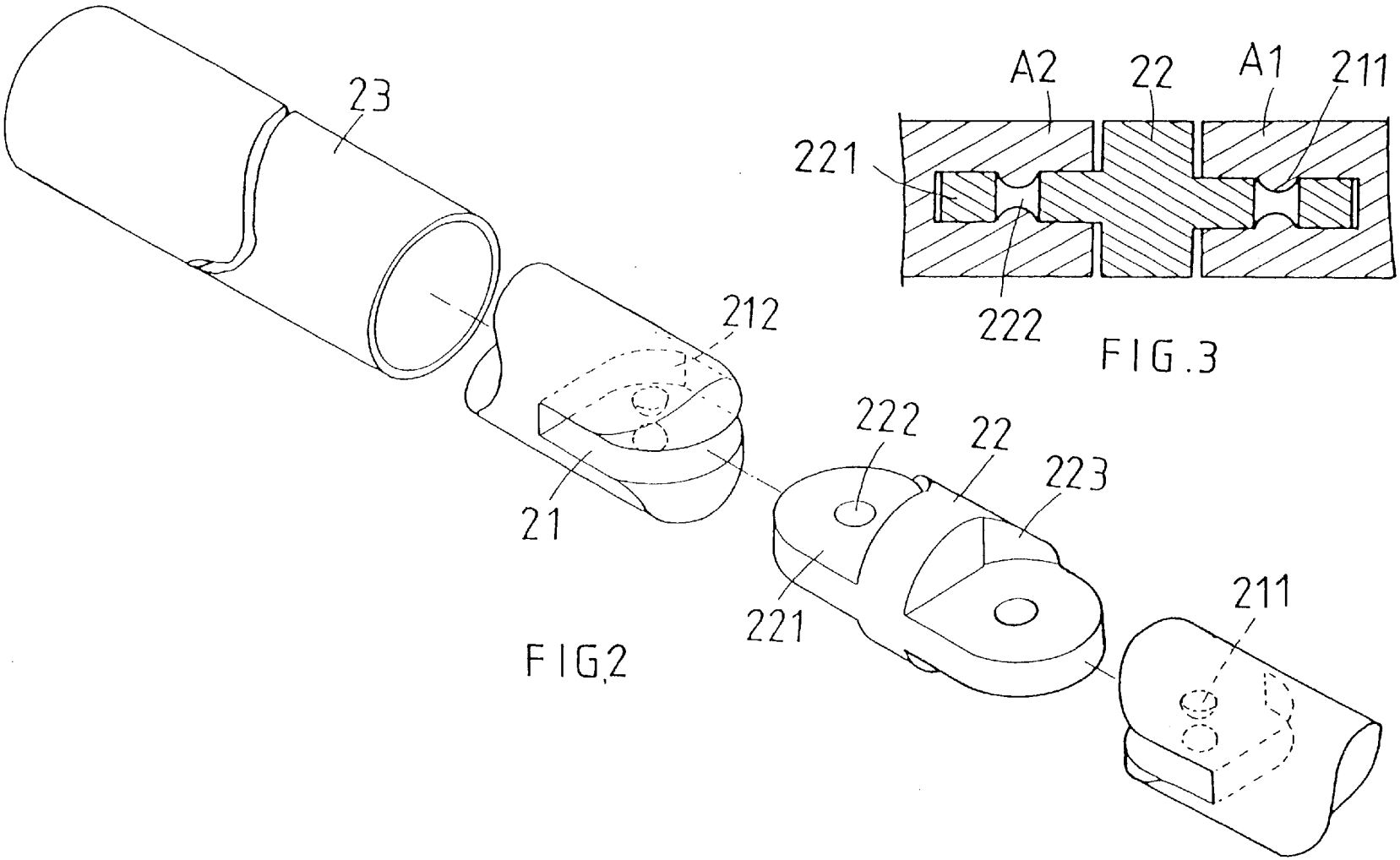
FIG. 2 is an exploded view to show a sleeve, a connection part and two ends of the two rods composing the siderail.
FIG. 3 is a cross-sectional view to show an engagement between the connection part and the two rods as shown in FIG. 2.

A first transverse bar "B" is received in a tube 12 on the flange on the lower end of the backboard 10, and two two-way connection members "C1" are respectively connected to two ends of the first transverse bar "B". Two foldable siderails are respectively connected the two two-way connection members "C" and a three-way connection member "C" is connected to a distal end of each siderail. A second transverse bar "B1" is connected between the two three-way connection members "C". A net member 3 is connected to one of the two side flanges and the siderail which is connected to the side flange. A bottom net is connected between the two siderails. Two legs 4 are respectively connected to the three-way connection members "C" so as to stand on the ground as shown in FIGS. 1, 8 or 9.

Figure 4:
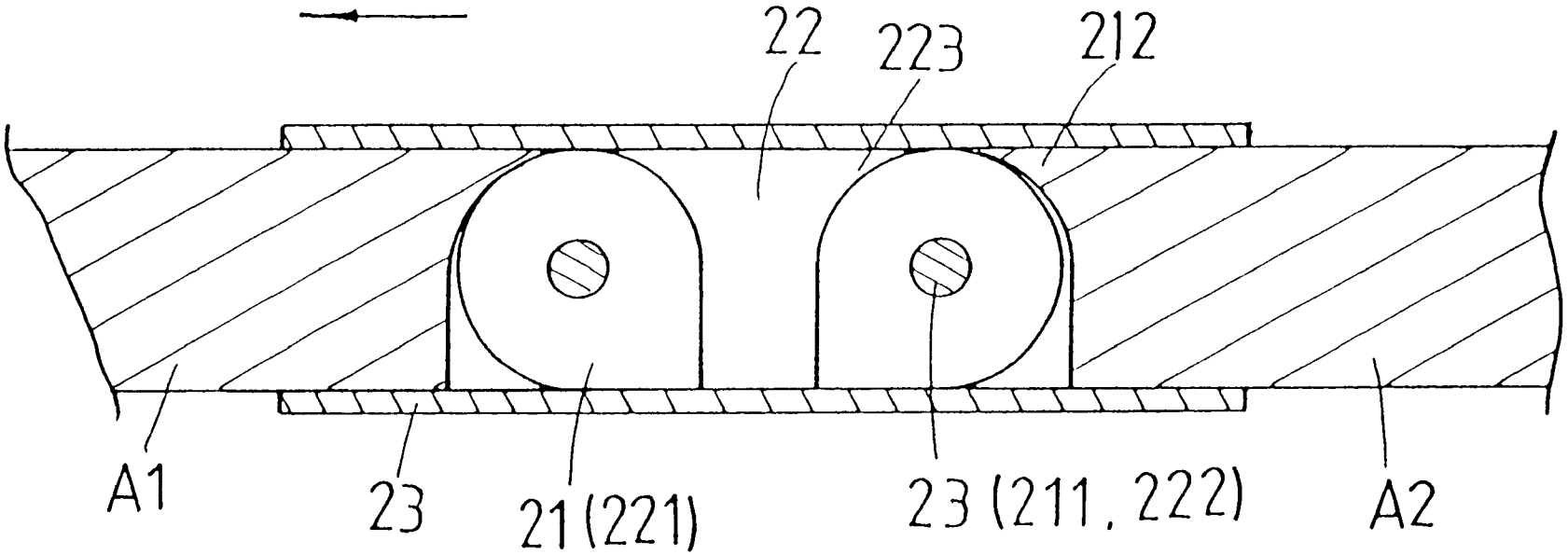
FIG. 4 is a cross sectional viewed form a top of the connection part to show the engagement between the connection part and the two rods as shown in FIG. 2.
Figure 5:
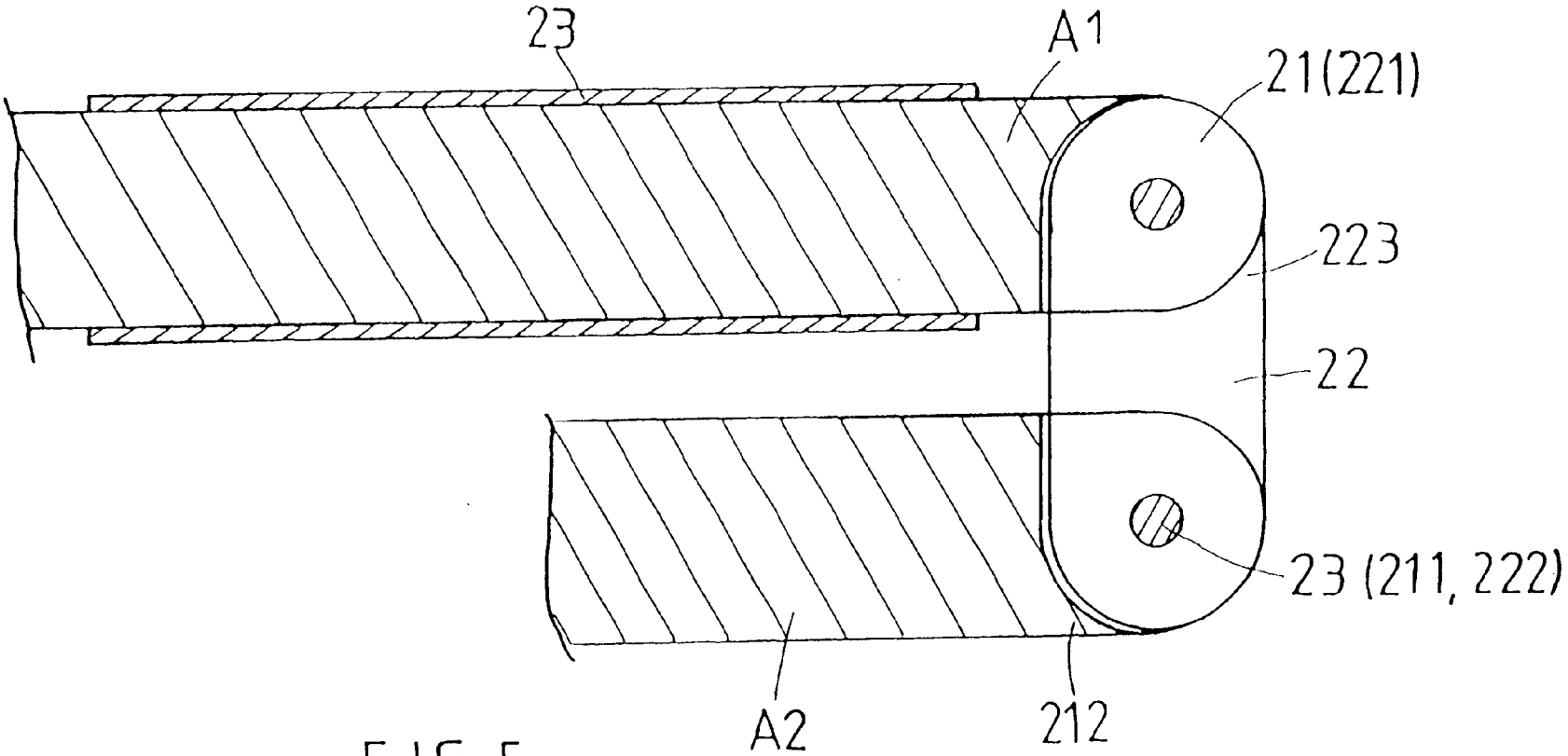
FIG. 5 is a cross sectional view to show the two rods are pivoted relative to the connection part.

Each siderail includes rods A1, A2 and A3, and two connection parts 22 are pivotally connected between the rods A1, A2 and A3. Each connection part 22 has two tongues 221 on two ends thereof and each tongue 221 has an aperture 222. Two limit curbs 223 respectively extend from two sides of the connection part 22. A limit curb 212 is defined in an end defining the slit 21. An end of each of the rods A1, A2 and A3 has a slit 21 so as to receive one of the two tongues 221 therein. Two bosses 211 respectively extend from two insides defining the slit 21 so that the two bosses 211 of each rod A1/A2/A3 are received in the aperture 222 in the tongue 221 received in the slit 21. Therefore, the rods A1, A2 and A3 can be respectively pivoted relative to the bosses 211 as shown in FIG. 5 and the limit curbs 22, 223 are used to prevent the rods A1, A2 and A3 from disengaging from the connection part 22. A sleeve 23 painted by fluorescent paint is movably mounted to the connection part 22, an end of each of the rods A1, A2 and A3 and the connection part 22 are received in the sleeve 23. Accordingly, as shown in FIG. 4, the sleeve 23 limits the pivoting action of the rods A1, A2 and A3 when the rods are received in the sleeve 23. This reinforces the structural strength of the siderails so that the siderails will not be collapsed when being hit.

Figure 7:
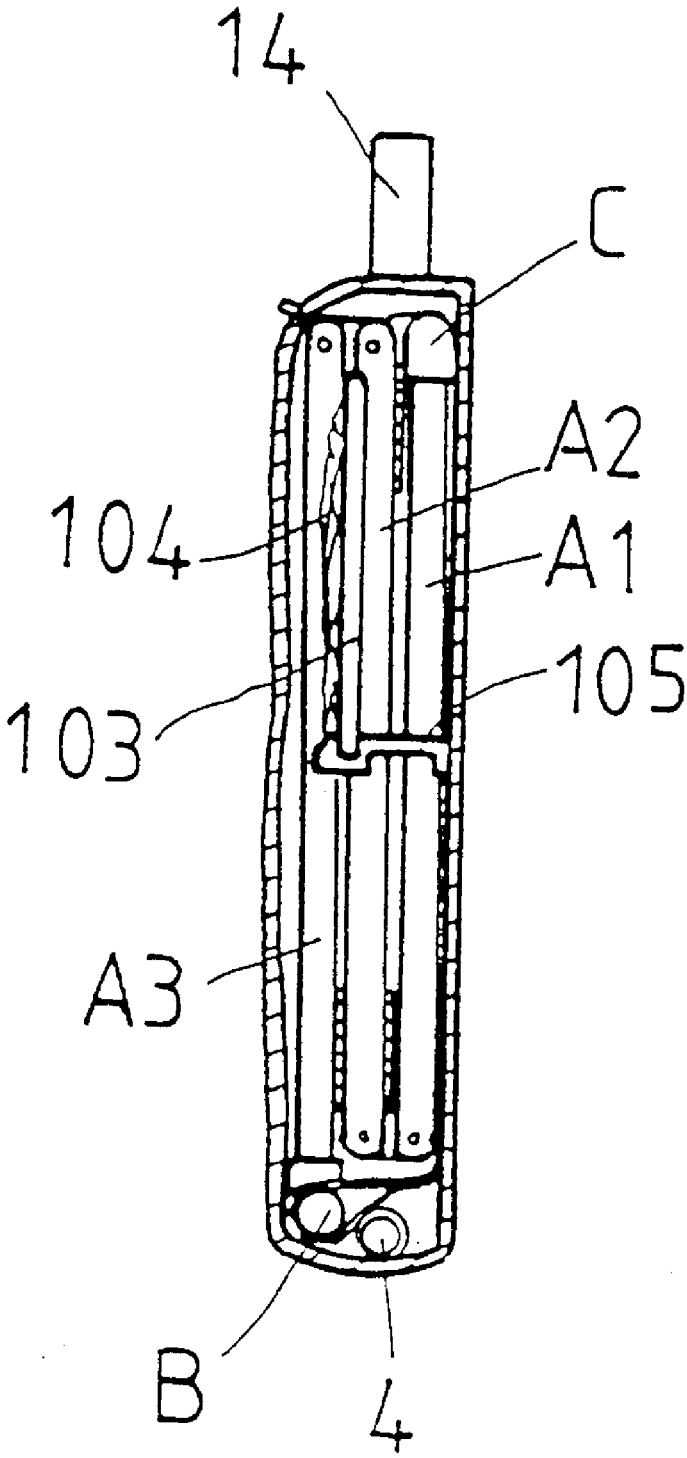
FIG. 7 is an illustrative view to show the frame assembly is folded and received in a bag.

Referring FIGS. 6 and 7, the siderails can be pivoted to overlap with each other by shifting the sleeves 23 from the pivotal points so as to become a short assembly and the short assembly can be received in a space enclosed by the four flanges 102. The sleeves 23 effectively reinforce the structural strength of the siderails so that the siderails will not be collapsed when being hit. The sleeves 23 and the rectangle 100 are painted by fluorescent paint so that the assembly can be used in gloomy area.

While we have shown and described various embodiments in accordance with the present invention, it should be clear to those skilled in the art that further embodiments may be made without departing from the scope and spirit of the present invention.

What is claimed is:

1. A foldable basketball frame assembly comprising:

a backboard having four flanges extending from four sides of said backboard, said four flanges being a top flange, two side flanges and a bottom flange, a cover connected to said bottom flange on a lower end of said backboard, said backboard having a rim hoop pivotably connected thereto;

a first transverse bar connected to said flange on said lower end of said backboard, two two-way connection members respectively connected to two ends of said first transverse bar, two foldable siderails respectively connected said two two-way connection members and a three-way connection member connected to a distal end of each siderail, a second transverse bar connected between said two three-way connection members, each siderail including two rods and a connection part pivotally connected between said two rods, a sleeve movably mounted to each of said connection parts, an end of each of said two rods and said connection part received in said sleeve, each of said connection part having two tongues on two ends thereof and each tongue having an aperture, an end of each of said two rods having a slit so as to receive one of said two tongues therein, two bosses respectively extending from two insides defining said slit, said two bosses of each rod received in said aperture in said tongue received in said slit;

two legs respectively connected to said three-way connection members.

2. The assembly as claimed in claim 1 further comprising a ring connected to said top flange on a top of said backboard.

3. The assembly as claimed in claim 1 further comprising a net member connected to one of said two side flanges and said siderail which is connected to said side flange.

4. The assembly as claimed in claim 1 further comprising a zipper means connected to said cover.

5. The assembly as claimed in claim 1 further comprising two holes defined through said backboard and located on two ends of said backboard.

6. The assembly as claimed in claim 1 wherein each sleeve is painted by fluorescent paint.

7. The assembly as claimed in claim 1 further comprising a rectangle painted on said backboard and located above said rim hoop, said rectangle being painted by fluorescent paint.

* * * * *